United States Patent [19]

Howeth

[11] Patent Number: 4,708,723

[45] Date of Patent: Nov. 24, 1987

[54] ROTARY BROOM SWEEPER HOPPER

[76] Inventor: D. Franklin Howeth, P.O. Box 6517, Fort Worth, Tex. 76115

[21] Appl. No.: 879,994

[22] Filed: Jun. 30, 1986

[51] Int. Cl.[4] ..... B01D 50/00

[52] U.S. Cl. ..... 55/321; 55/356; 55/429; 55/444; 15/340

[58] Field of Search ..... 15/340, 347, 349, 352; 55/300, 304, 319–321, 356, 429, 443, 444

[56] References Cited

U.S. PATENT DOCUMENTS

| | | | |
|---|---|---|---|
| 3,304,572 | 2/1967 | Wendel | 15/340 |
| 3,406,423 | 10/1968 | Young | 55/356 |
| 4,328,014 | 5/1982 | Burgoon et al. | 55/300 |
| 4,557,739 | 12/1985 | Fortman et al. | 55/320 |

FOREIGN PATENT DOCUMENTS

| | | | |
|---|---|---|---|
| 0468131 | 9/1914 | France | 15/340 |
| 0638313 | 5/1928 | France | 55/443 |
| 0015863 | of 1907 | United Kingdom | 15/340 |

*Primary Examiner*—Charles Hart

*Attorney, Agent, or Firm*—Hubbard, Thurman, Turner & Tucker

[57] ABSTRACT

Disclosed is a rotary broom hopper which includes a container having a bottom wall, a front wall, a rear wall, and a top wall. A dust and debris inlet is positioned between the bottom wall and the rear wall and a filter element is positioned between the rear wall and the top wall. A first interior wall extends into the container from the rear wall between the inlet and the filter element. A second interior wall is positioned between the first interior wall and the filter element such that the first and second interior walls form a secondary material separation chamber interior of the container. An impingement plate is positioned to extend perpendicular to the top wall into the secondary material separation chamber. The impingement panel causes an abrupt reversal of direction of air flow and deposits a substantial quantity of particulate matter in the secondary material separation chamber and thereby reduces the accumulation of such material on the filter element.

11 Claims, 2 Drawing Figures

ROTARY BROOM SWEEPER HOPPER

BACKGROUND OF THE INVENTION

A. Field of the Invention

The present invention relates generally to rotary broom sweeper hoppers and more particularly to a rotary broom sweeper hopper with improved means for removing particles from the dust laden air stream prior to final filter interception.

B. Description of the Prior Art

Rotary broom sweepers typically include a self-propelled vehicle which carries a horizontally mounted rotating broom that is positioned to sweep material from the surface over which the sweeper travels into a dust and debris hopper. The hopper is a box-like structure having an inlet opening to receive material from the rotary broom. A filter assembly is positioned in the hopper to divide the hopper into a dust and debris receiving chamber and an exhaust chamber. The hopper includes an exhaust blower to establish a flow of air through the hopper from the inlet opening to the filter assembly.

An example of a rotary broom sweeper hopper is disclosed in Burgoon, et al. U.S. Pat. No. 4,328,014. In the hopper of the Burgoon patent the hopper inlet is positioned between the rear wall and the bottom wall and the filter assembly and exhaust blower are positioned near the rear and top walls of the hopper. Thus, the air stream enters the hopper at the lower rear and makes a sweeping 180° turn along the hopper floor and front wall and migrates along the top wall of the hopper where it is finally intercepted by the filter. It is contemplated that the majority of the dirt and debris particles will be removed from the air flow stream by centrifugal force as the stream makes the 180° turn. However, the uplifting action of the air stream along the front wall of the hopper sweeps a substantial number of particles across the top wall. Thus, a substantial amount of particulate matter which could have been removed by centrifigal action is retained in the air flow stream and is deposited on the filter. The excess material deposited on the filter decreases the efficiency of the filter and sweeper.

Additionally, some of the particulate matter swept along the top wall of the hopper drops to the bottom wall of the hopper. The dropped material creates a mound in the debris throw area immediately in front of the broom. This mound undesirably disrupts both the particle trajectories and air flow as dust and debris is projected into the hopper from the rotary broom. Such disruption further decreases the efficiency of the sweeper.

It is therefore an object of the present invention to provide a rotary broom sweeper hopper that overcomes the shortcomings of the prior art. More particularly, it is an object of the present invention to provide an improved rotary broom sweeper hopper in which the energy from the hopper air flow stream is utilized to increase particulate removal from the air flow stream prior to interception by the filter. It is a further object of the present invention to provide an improved rotary broom sweeper hopper in which the mound of debris and other particulate matter in the broom throw area is decreased in size or eliminated.

SUMMARY OF THE INVENTION

Briefly stated, the hopper of the present invention includes a housing having a rear wall, a bottom wall, and a top wall, with a dust and debris inlet positioned between the bottom wall and the rear wall. A filter element is positioned in the housing adjacent the rear and top walls. A first interior wall extends from the rear wall between the inlet and the filter element. A second interior wall is positioned between the filter element and the first interior wall. The first and second interior walls form a secondary material receiving chamber. An impingement panel is positioned generally perpendicular to the top wall and extends into the secondary material receiving chamber. The impingement panel causes the air flow along the top wall of the chamber to reverse directions abruptly and deposit a substantial quantity of particulate matter in the secondary material receiving chamber. The impingement panel and secondary material receiving chamber thus cooperate to reduce the amount of particulate material reaching the filter. Additionally, the secondary material receiving chamber collects this material out of the main hopper air flow stream and thus prevents the formation of the mount in the broom throw area.

The secondary material receiving chamber is positioned so as to freely dump its contents during dumping of the hopper. The impingement panel may be hingedly mounted in the hopper so as to pivot freely out of the way during dumping. The hinged mounting of the impingement panel also enhances the removal of any dirt or debris caked to the upstream face of the panel.

DESCRIPTION OF THE PREFERRED EMBODIMENT

Figure 1:
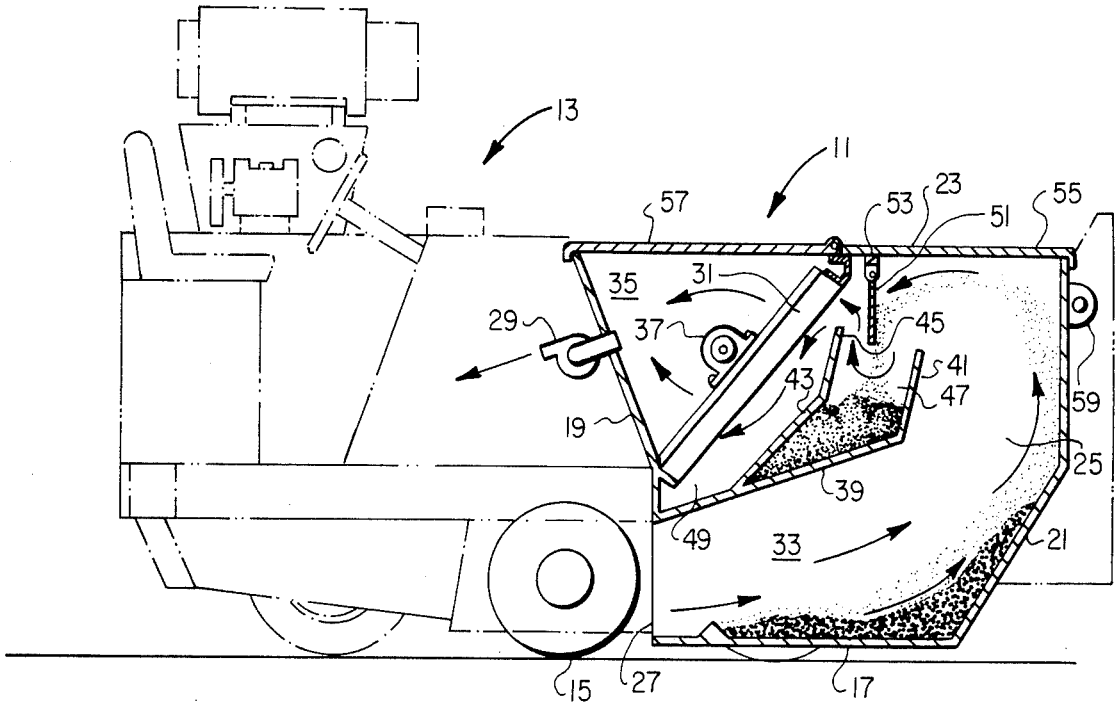
FIG. 1 is a sectional view of the hopper of the present invention in the operating position.

Referring now to the drawing, the hopper of the present invention is designated generally by the numeral 11. Hopper 11 is a component of a rotary broom sweeper shown in phantom and designated generally by the numeral 13. Sweeper 13 is self-propelled and includes a horizontal rotary broom 15 mounted near the mid-point of sweeper 13. Rotary broom 15 is rotated to sweep dust and debris in a forward direction into hopper 11.

Hopper 11 is a box-like structure having a bottom wall 17, a rear wall 19, a front wall 21, a top wall 23 and spaced apart side walls 25. The walls of hopper 11 form a housing having a dust and debris inlet 27 positioned between bottom wall 17 and rear wall 19 to receive dust and debris from rotary broom 15. Hopper 11 has a width between side walls 25 substantially equal to the length of rotary broom 15 and inlet 27 extends substantially from side wall to side wall.

Hopper 11 includes an exhaust blower designed schematically by the numeral 29. Exhaust blower 29 is positioned to receive air from hopper 11 at rear wall 19 near top wall 23. A panel filter element 31 is mounted within hopper 11 to divide hopper 11 into a debris chamber 33 and a clean air exhaust chamber 35. In the disclosed embodiment, filter element 31 is a rectangular reinforced pleated filter suitably mounted between top wall 23, rear wall 19 and side walls 25. Filter element 31 may be constructed and mounted in the manner disclosed in U.S. Pat. No. 4,328,014, which is incorporated herein by reference. Filter element 31 is provided with a self-cleaning mechanism, which in the embodiment described herein is an electrically driven eccentric weight shaker 37 mounted to filter element 31. Shaker 37 is operated continuously or intermittently to vibrate filter element 31 to dislodge dust accumulations from filter element 31. Those skilled in the art, of course, will recognize that the filter element may take other forms. For example, the filter element may be one or more cylindrical, oval, or other shaped barrier-type filters mounted to a clean air plenum disposed in the upper rear portion of hopper 11. The exhaust blower would, of course, be connected to the clean air plenum and the alternative filter element would, again, divide the hopper into a debris chamber and clean air exhaust chamber. Hopper 11 may also include alternative filter cleaning systems, as for example, a reverse flow flushing system.

Hopper 11 includes a first interior wall 39 which extends inwardly from rear wall 19 into debris chamber 33. Interior wall 39 extends across and is connected at both of its ends to side walls 25. First interior wall 39 thus constrains air flowing between inlet 27 and filter element 31 to flow in a tortuous path across bottom wall 27 and up front wall 21. The reversal of air flow direction at front wall 21 causes a substantial amount of debris and particulate matter to fall out of the air flow stream due to centrifigal forces.

A second interior wall 41 is connected to first interior wall 39 and extends across hopper 11 between side walls 25. Both first and second interior walls 39 and 41 include portions 43 and 45, respectively, which extend upwardly toward top wall 23. First and second interior walls 39 and 41 thus form a secondary material receiving chamber 47 disposed above bottom wall 17. First and second interior walls 39 and 41 also cooperate with portions 43 and 45 to form a third material receiving chamber 49 positioned to receive and retain particulate matter removed from filter element 31 during cleaning.

An impingement panel 51 is positioned in hopper 11 to extend generally perpendicular from top wall 23 into secondary material receiving chamber 47. Impingement panel 51 may be a single rectangular panel extending across hopper 11 between side walls 25 or may comprise a plurality of separate panel segments extending between side walls 25. In either event, impingement panel 51 causes the air flow stream to reverse directions abruptly over secondary material receiving chamber 47. The abrupt reversal of flow stream direction causes particulate material to be removed from the flow stream due to centrifugal force and be deposited in secondary material receiving chamber 47. Also, particulate material is removed from the flow stream by impingement upon impingement panel 51.

Secondary material receiving chamber 47 forms a dead air space within which particulate material is not likely to be swept back into the air flow stream. Also, the downward and rearward slope of first interior wall 39 causes separated material to migrate away from the air flow stream due to gravity, thereby further preventing reentrainment of separated material. Impingement panel 51 is preferably hingedly connected in hopper 11 along its upper edge. In the embodiment shown, impingement panel 51 is hingedly connected to a mounting bar 53 connected between side walls 25. Impingement panel 51 may also be hingedly connected directly to top wall 23.

Top wall 23 preferably includes a pair of lid sections 55 and 57. Lid section 55 is positioned to provide access to debris chamber 33 and lid section 57 is positioned to provide access to clean air exhaust chamber 35. Suitable latches (not shown) may be provided for latching lid sections 55 and 57 in a closed position, as shown in FIG. 1.

Figure 2:
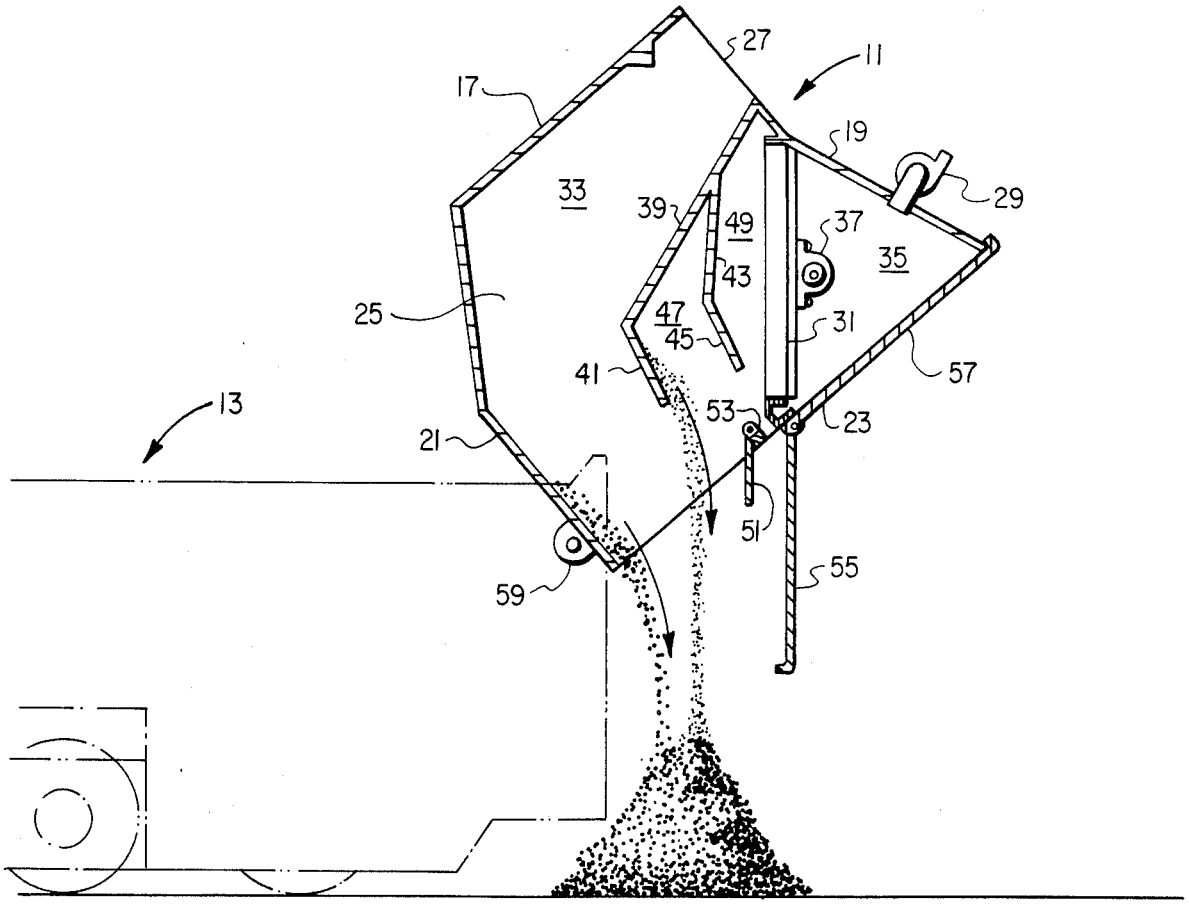
FIG. 2 is a sectional view of the hopper of the present invention in the dumping position.

Hopper 11 is pivotally mounted by a bracket or the like 59 to sweeper 13 to be movable from an operating position, as shown in FIG. 1, to a dumping position as shown in FIG. 2. In the dumping position, lid section 55 is open so that dust and debris may pour out of hopper 11. As shown in FIG. 2, impingement panel 51 pivots out of hopper 11 to a position parallel to open lid section 55. The pivoted impingement panel 51 thus allows unimpeded dumping of material in secondary material receiving chamber 47 and third material receiving chamber 49. After dumping, hopper 11 is pivoted back to the position shown in FIG. 1 to resume sweeping operations.

It can be seen that primary separation of debris and dust swept into inlet 27 by rotary broom 15 occurs when the air flow stream is swept upwardly and rearwardly at front wall 21. However, a substantial amount of dust and debris is carried up front wall 21 and rearwardly along top wall 23. The combination of impingement panel 51 and secondary receiving chamber 47 causes a substantial removal of particulate material which would otherwise be deposited upon filter element 31 or dumped to obstruct inlet 27. Thus, it can be seen that the present invention substantially improves the efficiency of sweeper 13.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the form of the invention herewith shown and described is to be taken as the presently preferred embodiment. Various changes may be made in the shape, size, and arrangment of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. A dust and debris hopper for a rotary broom sweeper, which comprises:

a housing including a rear wall, a bottom wall, and a top wall, said housing including a dust and debris inlet positioned between said bottom wall and said rear wall;

a filter element positioned in said housing adjacent said rear wall and said top wall;

a first interior wall extending from said rear wall between said inlet and said filter element, at least a portion of said interior wall projecting toward said top wall, said interior wall defining a tortuous flow path of air between said inlet and said filter element;

a second interior wall positioned between said filter element and said first interior wall, at least a portion of said second interior wall projecting toward said top wall, said second interior wall and said first interior wall forming a secondary material receiving chamber therebetween, said secondary material receiving chamber being positioned upstream from said filter element;

and an impingement panel positioned generally perpendicular to said top wall and extending into said secondary material receiving chamber, whereby the air flow between said inlet and said filter element reverses direction about said panel in said secondary material receiving chamber.

2. The dust and debris hopper as claimed in claim 1, wherein said second interior wall is connected to said first interior wall.

3. The dust and debris hopper as claimed in claim 1, wherein:

said housing is pivotally mounted to said sweeper and movable between an operating position and dumping position;

said top wall includes a hinged lid which is movable to an open position when said housing is in said dumping position;

and said impingement panel is pivotal to provide substantially unimpeded emptying of said secondary material receiving chamber when said housing is in said dumping position.

4. A dust and debris hopper for a rotary broom sweeper, which comprises:

a housing including a front wall, a rear wall, a bottom wall, and a top wall, said housing including an inlet positioned between said bottom wall and said rear wall;

a filter element positioned in said housing adjacent said rear wall and said top wall;

a first interior wall extending forwardly from said rear wall between said inlet and said filter element, said first interior wall defining with said bottom, front and top walls a substantially unobstructed first flow path portion through which particulate-laden air flowed inwardly through said inlet and outwardly through said filter element is caused to reverse to thereby impart a centrifugal separation action to the particulate-laden air, said first flow path portion having a downstream end;

and an impingement panel extending generally perpendicularly to said top wall and defining said downstream end of said first flow path portion, said impingement panel being positioned to be impinged by particulate-laden air traversing said first flow path portion and defining with said first interior wall an inlet section of a second flow path portion communicating said first flow path portion with said filter element.

5. The dust and debris hopper as claimed in claim 4, including:

a second interior wall positioned with respect to said first interior wall to form therewith a secondary material chamber beneath said impingement panel, said second interior wall being positioned relative to said impingement panel to create a flow reversal of particulate-laden air traversing said second flow path portion.

6. The dust and debris hopper as claimed in claim 5 wherein said first and second interior walls each include a portion extending upwardly toward said top wall.

7. The dust and debris as claimed in claim 5, wherein said second interior wall is connected to said first interior wall.

8. The dust and debris hopper as claimed in claim 5 wherein:

said impingement panel extends downwardly into said said secondary material chamber.

9. An improved rotary broom sweeper comprising:

a self-propelled vehicle;

a hopper carried by said vehicle for movement therewith, said hopper having an inlet opening and an outlet opening;

a rotationally drivable broom element carried by said vehicle for movement therewith and adapted to sweep dust and debris into said inlet opening;

a filter mounted within said hopper and operably interposed between said inlet opening and said outlet opening;

wall means disposed within said hopper for defining therein;

an internal flow path extending between said inlet opening and said filter, said flow path having an upstream portion extending inwardly from said inlet opening and shaped to cause a first directional reversal of particulate-laden air flowing therethrough, and a downstream portion communicating with said upstream portion and terminating at said filter, and a secondary material receiving chamber communicating with said flow path adjacent the juncture of said upstream and downstream portions thereof;

an impingement panel positioned to be impinged by and cause a second directional reversal of particulate-laden air flowing from said upstream portion of said flow path into said downstream portion thereof, said second directional reversal occurring within said secondary material receiving chamber; and an exhaust blower connected to said outlet opening and operative to sequentially flow particulate-laden air into said inlet opening, through said internal flow path, across said filter, and outwardly through said outlet opening.

10. The improved rotary broom sweeper of claim 9 wherein:

said secondary material receiving chamber has a generally upwardly facing open inlet portion, and said impingement panel extends downwardly into said open inlet portion.

11. The improved rotary broom sweeper of claim 10 wherein:

said hopper is mounted on said vehicle for pivotal movement relative thereto between an operating position and a dumping position, said hopper has a top wall with a hinged lid thereon that is movable to an open position when said hopper is in said dumping position, and said impingement panel is pivotable relative to said hopper to provide substantially unimpeded emptying of said secondary material receiving chamber when said hopper is in said dumping position.

* * * * *